United States Patent [19]

Grabner et al.

[11] Patent Number: 4,468,942

[45] Date of Patent: Sep. 4, 1984

[54] PNEUMATIC CENTRAL LOCKING SYSTEM

[75] Inventors: Christian Grabner, Gechingen; Klaus-Jürgen Heimbrodt, Böblingen; Dieter Feichtiger, Aidlingen, all of Fed. Rep. of Germany

[73] Assignee: Daimler-Benz Aktiengesellschaft, Fed. Rep. of Germany

[21] Appl. No.: 319,069

[22] Filed: Nov. 6, 1981

[30] Foreign Application Priority Data

Nov. 6, 1980 [DE] Fed. Rep. of Germany ..... 3041827

[51] Int. Cl.[3] ..... E05B 65/36

[52] U.S. Cl. ..... 70/264

[58] Field of Search ..... 70/264, 262, 263; 180/289; 200/83 B, 83 Q, 83 J, 83 Y

[56] References Cited

U.S. PATENT DOCUMENTS

| | | | |
|---|---|---|---|
| 3,019,848 | 2/1962 | Garvey | 70/264 |
| 3,030,794 | 4/1962 | Dyer | 70/264 |
| 3,096,112 | 7/1963 | Johnstone | 70/264 |
| 3,653,237 | 4/1972 | DuRocher | 70/264 |
| 4,181,191 | 1/1980 | Hoffmann | 180/289 |
| 4,253,319 | 3/1981 | Feichtiger | 70/264 |

FOREIGN PATENT DOCUMENTS

| | | | |
|---|---|---|---|
| 2386671 | 12/1978 | France | 70/264 |

*Primary Examiner*—Robert L. Wolfe

*Attorney, Agent, or Firm*—Craig & Burns

[57] ABSTRACT

A pneumatic central locking system for doors and/or lids in motor vehicles, with a pneumatic operating or locking element being provided for each lock mechanism of the doors and/or lids so as to enable the same to be locked and unlocked. An electrically drivable air pump is connectible with the locking elements by a line system and a selector valve is disposed at an outlet side of the air pump. The selector valve acts upon the line system and/or the locking elements in a desirable manner by means of an additional pneumatic operating or switching element connected fluidically in parallel at the locking elements. A response pressure of the switch element is higher than that of the locking elements. At least one lock mechanism contains a key operable first selector switch, with a second selector switch which may be operated by the switching element. Both of these selector switches are connected by power leads to the electric drive for the air pump and are connected electrically in series with one another in such a fashion that when the central locking system is in a steady state, the power to the electric drive is interrupted. In addition to a pressure dependent actuation of the second selector switch, the switching element also provides an additional operating drive for the second selector switch which responds as a function of time.

18 Claims, 3 Drawing Figures

PNEUMATIC CENTRAL LOCKING SYSTEM

Figure 1:
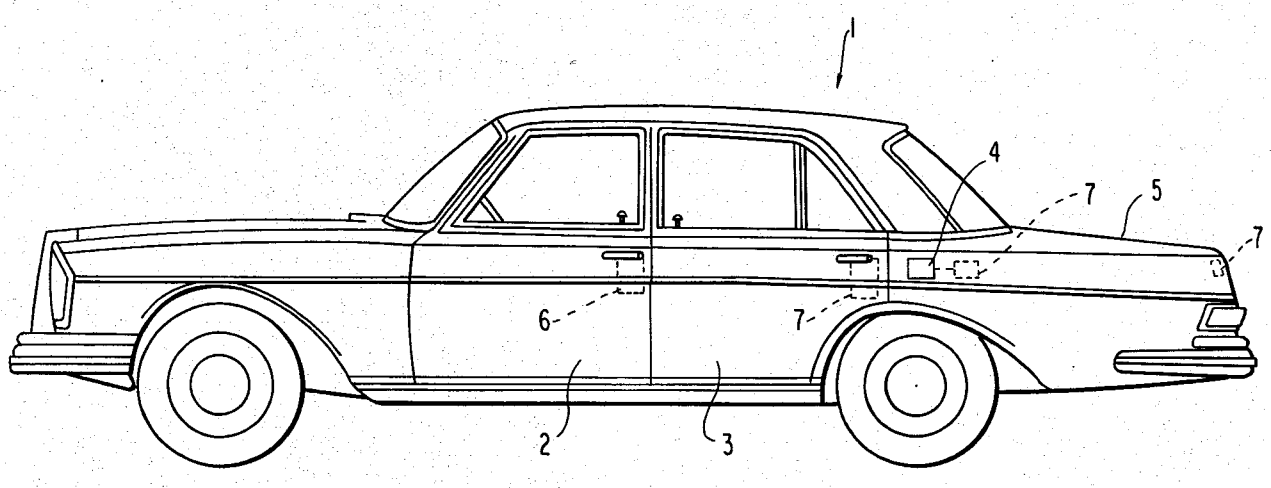

The present invention relates to a locking system and, more particularly, to a pneumatic central locking system for locking doors and/or lids of motor vehicles.

In, for example, Offenlegungsschrift No. 2,826,354, a pneumatic central locking system of the aforementioned type is proposed which includes a pneumatic operating or locking element at each lock mechanism of the doors or lids to lock and unlock them. The system includes an air pump which is electrically drivable and connectible with the locking elements by a line or conduit system, a selector valve disposed at an outlet of the air pump and acting upon the line system and/or the locking or operating elements in a desirable manner by means of an additional pneumatic operating or switching element which is connected fluidically in parallel with the locking elements, whereby the response pressure of the switch element is made higher than that of the locking elements. At least one lock mechanism contains a key-operable first selector switch which can be operated by the switching element, with both of the selector switches being connected power leads to the electric drive for the air pump and connected electrically in series with one another in such a manner that when the central locking system is in a steady state, the power to the electric drive is interrupted.

Further central locking systems of the aforementioned type have been proposed in, for example, U.S. Pat. No. 3,096,112 and Offenlegungsschrifts Nos. 2.805,004, 2,715,136, and 2,742,666.

A special feature of the proposed central locking system resides in the fact that the pneumatic auxiliary power for the central and common actuation of all the lock mechanisms is generated as required by an electrically drivable air pump, which pump is normally turned off as a function of pressure after a locking operation is complete. The pressure limit for triggering the pump shut-off is deliberately made higher than a response threshhold for the pneumatic operating elements which perform the locking operation in order to ensure that the pump will not shut-off until all the locking mechanisms have been actuated.

While there are many advantages resulting from the use of pneumatic auxiliary powers for central locking systems, a disadvantage of the proposed locking systems resides in the fact that the air pump can be overloaded in mountainous areas so that, for example, it is no longer able to reach the response threshhold for the switching element to shut-off the air pump.

In order to avoid the above noted disadvantage of the air pump continuing to run, in addition to a pressure dependent shut-off of the second selector switch, it is also possible to provide a time dependent shut-off of the electric motor. However, a disadvantage of the provision of the time dependent shut-off resides in the fact that the central locking system is rendered inoperative because the air pump is permanently shut-off and may only be re-started through the intervention of a repair man. While another possible remedy for the above-noted situation would be a sufficient dimensioning of the air pump so as to permit it to reliably reach the switching pressure to shut-off the electric drive under all circumstances especially at high altitudes. A disadvantage of this remedy resides in the fact that to so dimension the air pump would result in unacceptably high prices for the air pump and also an unacceptable increase in weight for the re-dimensioned air pump.

The aim underlying the present invention essentially resides in providing a pneumatic central locking system which ensures a reliable shut-off of the air pump even in a very reduced atmospheric pressure without the air pump having to be excessively over-dimensioned.

In accordance with advantageous features of the present invention, in addition to a pressure dependent actuation of the second selector switch, the switching element also provides for additional operating drive for the second selector switch as a function of time.

By virtue of the above-noted features of the present invention, with the second actuation drive for the second selector switch, which operates purely as a function of time, it is ensured that if the pressure dependent actuating drive fails, the second selector switch will be thrown after a certain period of time thus shutting off the electric drive and switching the selector valve to a new position as required for the next locking operation. This advantageously enables the central locking system to remain completely functional even when the ambient air pressure is very much reduced. In accordance with further advantageous features of the present invention, the second actuating device of the second selector switch may be in the form of an electromagnetic or pneumatic drive.

The electromagnetic drive may, for example, be switched by a timer which, for example, may be a bimetallic switch located in a power supply to an electric drive of the air pump.

With the additional actuating drive, an additional pneumatic operating element in the form of a working chamber is provided, with the additional pneumatic operating element being connected and operating in parallel fluidically and mechanically with the switching element, and with a throttle being disposed as a timer in the supply to the pneumatic operating element.

It is also possible in accordance with the present invention to provide a heatable bimetallic spring to function as an additional actuating drive.

Accordingly, it is an object of the present invention to provide a pneumatic central locking system which avoids, by simple means, shortcomings and disadvantages encountered in the prior art.

Another object of the present invention resides in providing a pneumatic central locking system which functions reliably under all atmospheric conditions.

Yet another object of the present invention resides in providing a pneumatic central locking system for locking doors and/or lids of a motor vehicle which is simple in construction and therefore relatively inexpensive to manufacture.

A still further object of the present invention resides in providing a pneumatic central locking system which ensures that a sufficiently high switching pressure for lock mechanisms of the locking system are always produced.

Figure 2:
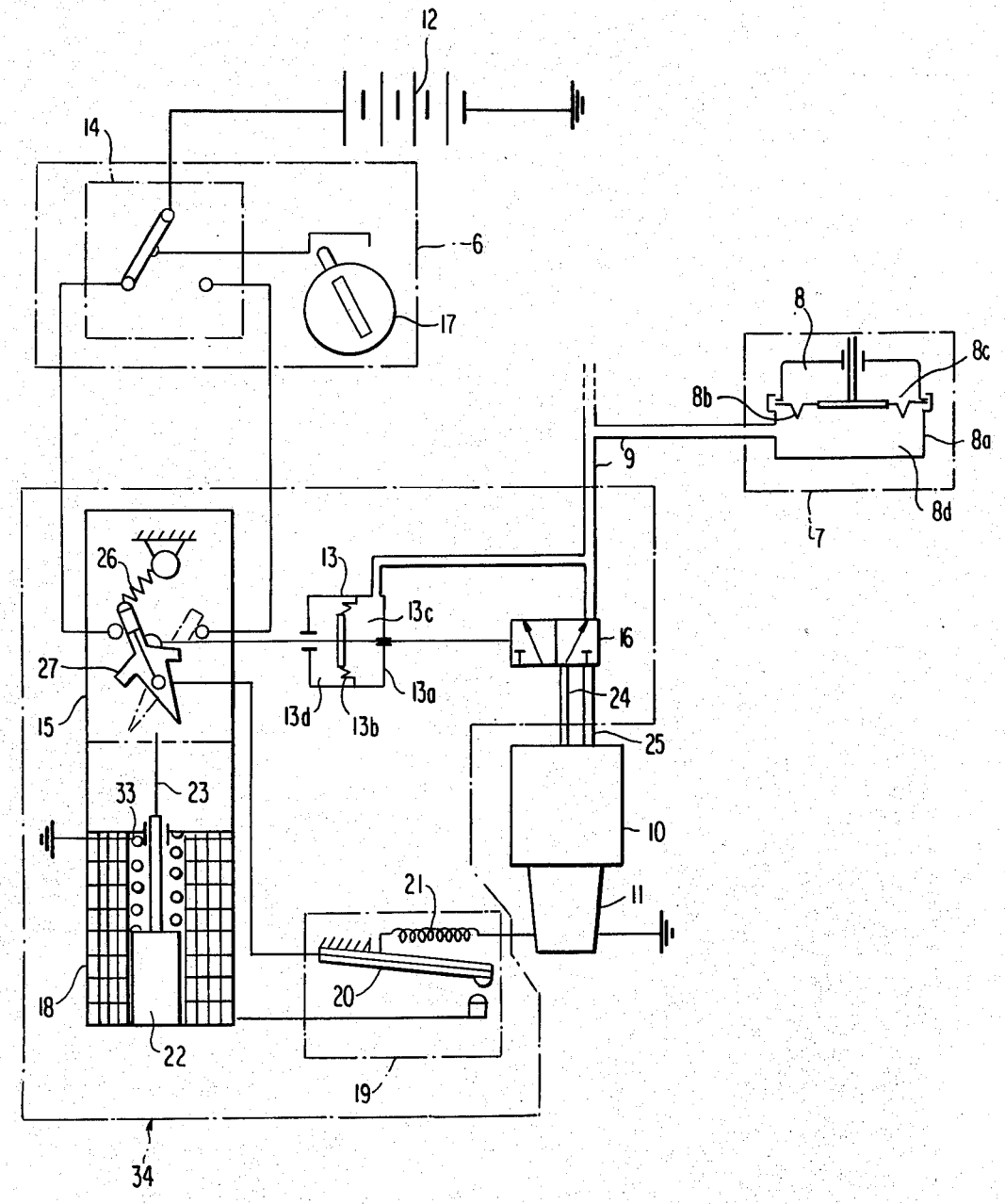
Figure 3:
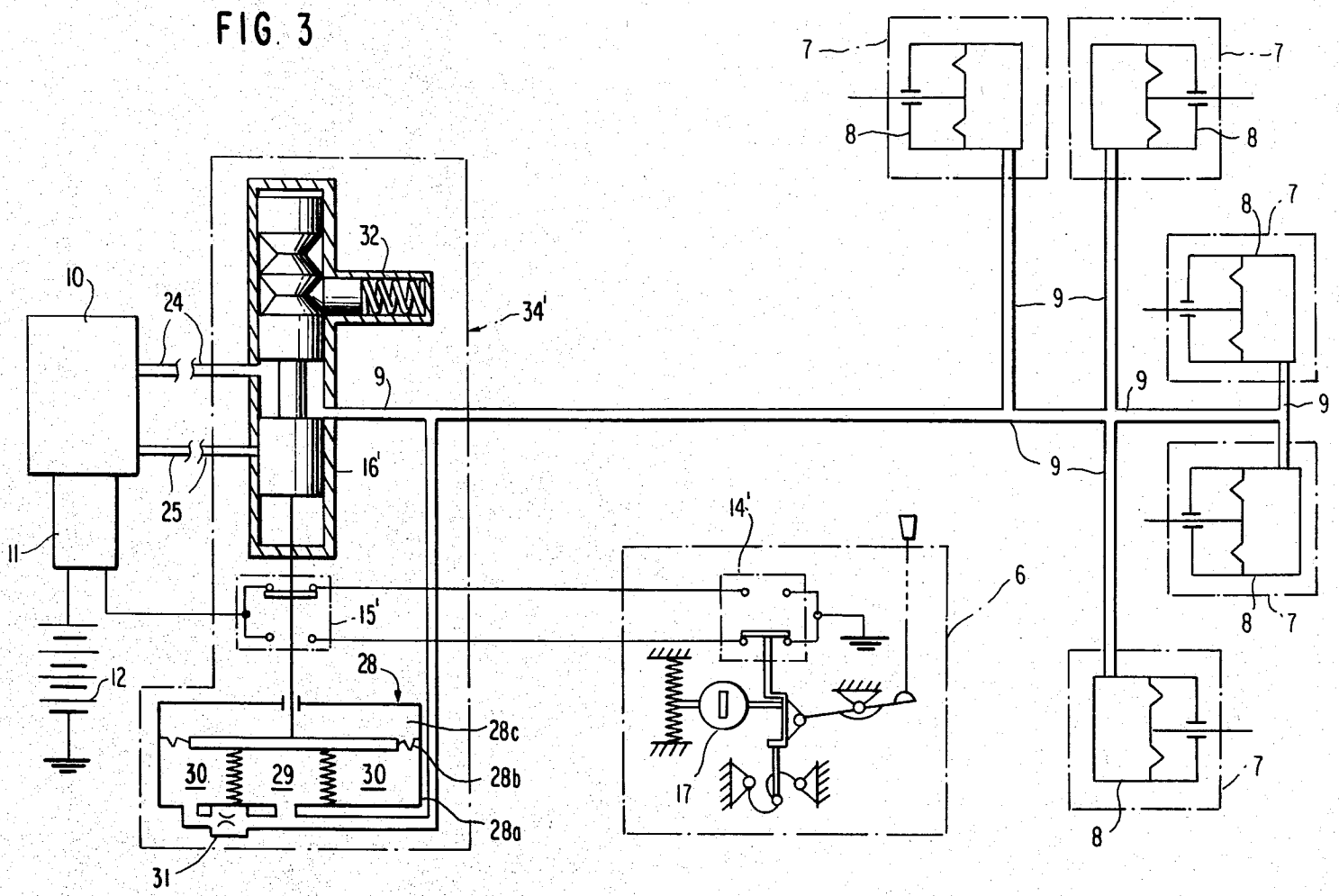

These and other objects, features, and advantages of the present invention will become more apparent from the following description when taken in connection with the accompanying drawing which shows, for the purposes of illustration only, two embodiments in accordance with the present invention, and wherein:

FIG. 1 is a side elevational view of a motor vehicle equipped with a central locking system constructed in accordance with the present invention;

FIG. 2 is a schematic diagram of a first embodiment of a pneumatic central locking system, in accordance with the present invention, in a transitional position during a locking operation, with an electromagnetic auxiliary drive provided for a second selector switch; and FIG. 3 is a partial cross sectional schematic diagram of a second embodiment of a pneumatic central locking system, constructed in accordance with the present invention, provided with a pneumatic auxiliary drive for a second selector switch and/or a selector valve.

Referring now to the drawings wherein like reference numerals are used throughout the various views to designate like parts and, more particularly, to FIG. 1, according to this figure, a motor vehicle generally designated by the reference numeral 1 includes a door 2 disposed on a driver side of the vehicle 1, with the door 2 including a centrally activated locking mechanism 6. The vehicle 1 is provided with other doors 3, a gas tank cover 4, and a trunk lid 5. The doors 3, and tank cover 4, and trunk lid 5 include lock mechanisms 7 actuatable in unison by means of, pneumatic operating or control elements.

As shown most clearly in FIG. 2, the pneumatic control elements 8 include a housing 8*a* having arranged therein a flexible member such as, for example, a diaphragm 8*b*, for dividing the housing 8*a* into two working or pressure chambers 8*c*, 8*d* connectible by a system of lines or conduits 9 with an air pump 10. The air pump 10 is driven by an electric drive motor 11, with power for the electric drive motor 11 being supplied by a power supply such as, for example, a battery 12. A first selector switch 14 and a second selector switch 15, connected electrically in series, are provided between the battery 12 and the electric drive motor 11. The first selector switch 14 is located in the centrally actuated lock mechanism 6, with the selector switch 14 being adapted to be switched or thrown by using a key (not shown) insertable into a key operated lock cylinder 17.

FIG. 2 depicts the position of the elements in a non-steady state at the beginning of a locking operation of the central locking system, so that both selector switches 14, 15 in series close the circuit to the electric drive motor 11. In the steady state of the central locking system, the resting positions of the two selector switches 14, 15 are exactly opposite to one another so that the circuit is interrupted, with the second selector switch 15 serving to shut off the electric drive motor 11. A pneumatic operating or switching element 13 is provided as an actuating drive for the two selector switches 14, 15, with the operating or switching elements including a housing 13*a* divided by a flexible membrane such as, for example, a diaphragm 13*b*, into two working chambers 13*c*, 13*d*, with the working chamber 13*c* being connected to the line or conduit system 9 and fluidically connected in parallel with the locking elements 8.

By appropriately selecting the working resistances of the selector switch 15 and/or by appropriately selecting a working area of the diaphragm 13*b* of the operating or switching element 13, it can be ensured that the second selector switch 15 will only be thrown or switched after all the locking elements 8 have been connected. The pneumatic operating or switching element 13 is connected with a selector valve 16 so as to enable the selector valve 16 to be actuated by the switching or operating element 13. The selector valve 16 is disposed between an outlet side of the air pump 10 and the line system 9. The outlet side of the air pump 10 includes a suction line 24 and a pressure line 25, with the selector valve 16 connecting the suction line 24 and pressure line 25 of the air pump 10 to the line system 9. After a locking operation of the central locking system is complete, with the air pump shut off, the position of the selector valve 16 required for a carrying out of a subsequent locking operation can readily be set.

To ensure a reliable operation of the central locking system, a reliable response of the operating or switching element 13 is required. In order to ensure that the operating or switching element 13 responds even when the ambient air pressure is very much reduced, a second actuating drive, responding as a function of time, is provided for the second selector switch 15.

As shown in FIG. 2, the second actuating drive may take the form of an electromagnet 18 provided within a control part generally designated by the reference numeral 34 for this purpose, with the electromagnet 18 being connected with a time delay by a timer which, in the illustrated embodiment, may take the form of a bimetallic switch 19 provided with a bimetallic strip 20 heatable by a heating coil 21. When the electric drive is switched on, the bimetallic strip 20 is necessarily heated and gradually bends downwardly as a result of the heating so as to close the contact pair of the bimetallic switch 19 so that the coil of the electromagnet is energized and attracts armature 22. This action causes the leaf spring 23 to strike one of two operating notches 27 in the switch toggle of the second selector switch 15, pushing the second selector switch 15 to a middle position so that a top dead center spring 26 permits the toggle to snap into the other position.

A return spring 33 of the electromagnet 18 is adapted to push the armature 22 back into the starting position illustrated in FIG. 2. To switch the second selector switch 15 as a function of time, a small urging or biasing from the leaf spring 23 into one of the two operating notches 27 is, as a rule sufficient, because a relatively high force, although not quite sufficient, is already exerted on the switch toggle by the switching element 13. The additional switching pulse produces a complete switching of both the second selector switch 15 and the selector valve 16. As shown in FIG. 2, the selector value 16 may be coupled directly to the selector switch 15.

For the sake of completeness, it should be noted that the timer of the type used commonly heretofore in safety circuits may be used for directly disconnecting the electric drive instead of the bimetallic switch 19. However, instead of a direct disconnection of the electric drive motor 11, provision will be made for switching on electromagnet 18.

In the central locking system of FIG. 3, as with the system of FIG. 2, a first selector switch 14', a second selector switch 15', as well as a selector valve 16' are provided, with the selector switches 14', 15' and selector valve 16' being of a slightly different construction from their counterparts in FIG. 2. In the system of FIG. 3, two loading positions are controlled by a spring force which is bridgable to produce a specific working resistance in the form of, for example, a latch or locking means 32. A control part generally designated by the reference numeral 34' has, as an additional time-dependent actuating drive for the second selector switch 15' and/or selector valve 16', a pneumatic drive.

As shown in FIG. 3, a switching element generally designated by the reference numeral 28 includes a housing 28*a* having accommodated therein a flexible member such as, for example, a diaphragm piston means 28b, dividing the housing 28a into an upper working chamber 28c and a lower working chamber, with the lower working chamber being divided into two working chambers 29, 30 connected fluidically and mechanically in parallel. The centrally located smaller working chamber 29 is connected in an umimpeded fashion to the line system 9 and corresponds to the pressure dependent actuating drive for the selector switch 15' and or selector valve 16'. The larger annular working chamber 30 is disposed around the working chamber 29 and is connected by a throttle 31 to the line system 9. With the throttle 31, a pressure build-up can only occur in the working chamber 30 with a time delay; however, the pressure eventually reaches the same pressure as the pressure prevailing in the line system 9. Therefore, if an extremely low ambient air pressure renders the air pump 10 unable to build up a sufficiently high switching pressure in the working chamber 29 to throw the selector switch 15' and/or displace the selector valve 16', the insufficient working pressure builds up with a time delay in the working chamber 30 so that an entire surface of the diaphragm piston means 28b in the switching element 28 is exposed to the reduced working pressure. However, the large working surface of the diaphragm piston means 28b is definitely sufficient to produce a sufficiently high switching pressure for the selector switch 15' and/or selector valve 16'.

Another possibility for an additional actuating drive of the second selector switch 15 or 15' may consist of the utilization of an electrically heatable bimetallic spring whereby a heating coil associated with the bimetallic spring is energized simultaneously with the electric drive motor. The bimetallic spring may be connected to the second selector switch 15 or 15' and the selector valve 16 or 16' in such a way that when the heat causes the bimetallic spring to bend, it exerts an additional force on a switch toggle of the selector switch 15 or 15' which, regardless of the position of the switch, causes it to be thrown in the opposite direction.

While we have shown and described several embodiments in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A pneumatic central locking system for locking a plurality of members, the system including locking means associated with each of said plurality for locking and unlocking the respective members, each of the locking means including a locking element, electrically driven pump means for providing pneumatic power for the locking system, line means for connecting the pump means with each of the locking elements, switch means for controlling a supply of electric current to the pump means, means for operating the switch means in dependence upon a pressure in the central locking system, and further means for operating the switch means as a function of time.

2. A pneumatic central locking system according to claim 1, wherein the switch means includes at least one key operable first selector switch and a second selector switch, said second selector switch being operable by said means for operating said switch means in dependence upon a pressure, said first selector switch and said second selector switch being connected to the pump means and supply of electrical power in such a manner that when the central locking system is in a steady state condition, electrical power to the pump means is interrupted.

3. A pneumatic central locking system according to claim 2, the means for operating the switch means in dependence upon a pressure in the central locking system includes a pneumatic operating element connected to said second selector switch, a selector valve means being arranged between an outlet side of the pump means and the locking means for controlling an output of the pump means to the locking means, and means for fluidically connecting the pneumatic operating element in parallel with the locking means.

4. A pneumatic central locking system according to claim 3, wherein a response pressure of the pneumatic operating element is higher than a response pressure of the locking elements of the locking means.

5. A pneumatic central locking system according to claim 4, wherein the plurality of members locked by the central locking system includes at least one of door and lids of a motor vehicle.

6. A pneumatic central locking system according to one of claims 2, 3, 4, or 5, wherein the further means includes an electromagnetic means for operating the switch means, and timer means for controlling an operation of the electromagnetic means.

7. A pneumatic central locking system according to claim 6, wherein the timer means includes a bimetallic switch means arranged between the supply of electric current and the pump means.

8. A pneumatic central locking system according to one of claims 1, 2, 3, 4, or 5, wherein the further means includes a pneumatic operating element connected to and operating in parallel fluidically and mechanically with the means for operating the switch means in dependence upon a pressure in the central locking system, and timer means for controlling the further means.

9. A pneumatic central locking system according to claim 8, wherein the timer means includes a throttle means arranged in a supply line to the further means.

10. A pneumatic central locking system according to one of claims 1, 2, 3, 4, or 5, wherein the further means includes a heatable bimetallic spring means.

11. A pneumatic central locking system according to claim 1, wherein the means for operating the switch means in dependence upon a pressure in the central locking system includes a pneumatic operating element connected to said switch means, selector valve means being arranged between an outlet side of the pump means and the locking means for controlling an output of the pump means to the locking means, and means are provided for fluidically connecting the pneumatic operating element in parallel with the locking means.

12. A pneumatic central locking system according to claim 11, wherein the pneumatic operating element includes a housing means, flexible means for defining the housing means into two working chambers, said means for fluidically connecting the pneumatic operating element in parallel with the locking means being a pneumatic line.

13. A pneumatic central locking system according to claim 1, wherein the further means includes a pneumatic operating element comprising a housing means, means for dividing the housing means into upper and lower working chambers, means for dividing one of the working chambers into first and second chambers, means for communicating one of the first and second chambers with the pump means, and timer means for controlling the pneumatic operating element.

14. A pneumatic central locking system according claims 13, wherein the timer means includes a throttle means arranged in the means for communicationg one of the first and second chambers with the pump means.

15. A pneumatic central locking system for locking a plurality of members, the system including locking means associated with each of said plurality for locking and unlocking the respective members, each of the locking means including a locking element, electrically driven pump means for providing pneumatic power for the locking system, line means for connecting the pump means with each of the locking elements, switch means for controlling a supply of electric current to the pump means, means for operating the switch means in dependence upon a pressure in the central locking system, further means for operating the switch means as a function of time, said further means including an electromagnetic means for operating the switch means, and timer means for controlling an operation of the electromagnetic means.

16. A pneumatic central locking system according to claim 15, wherein the timer means includes a bimetallic switch means arranged between the supply of electric current and the pump means.

17. A pneumatic central locking system for locking a plurality of members, the system including locking means associated with each of said plurality for locking and unlocking the respective members, each of the locking means including a locking element, electrically driven pump means for providing pneumatic power for the locking system, line means for connecting the pump means with each of the locking elements, switch means for controlling a supply of electric current to the pump means, means for operating the switch means in dependence upon a pressure in the central locking system, further means for operating the switch means as a function of time, said further means including a pneumatic operating element having a housing means, flexible means for dividing the housing means into upper and lower working chambers, means for dividing one of the working chambers into first and second chambers, means for communicating one of the first and second chambers with the pump means, and timer means for controlling the pneumatic operating element.

18. A pneumatic central locking system according to claim 17, wherein the timer means includes a throttle means arranged in the means for communicating one of the first and second chambers with the pump means.

* * * * *